United States Patent [19]

Murphy

[11] 4,104,955

[45] Aug. 8, 1978

[54] COMPRESSED AIR-OPERATED MOTOR EMPLOYING AN AIR DISTRIBUTOR

[76] Inventor: John R. Murphy, Rte. One, Smithville, Miss. 38878

[21] Appl. No.: 804,279

[22] Filed: Jun. 7, 1977

[51] Int. Cl.[2] ..... F01L 15/16; F01L 25/06; F01B 15/00

[52] U.S. Cl. ..... 91/176; 91/188; 91/273; 91/304; 91/446

[58] Field of Search ..... 91/188, 273, 304, 176

[56] References Cited

U.S. PATENT DOCUMENTS

| | | | |
|---|---|---|---|
| 372,342 | 11/1887 | Sylvester | 91/304 |
| 896,571 | 8/1908 | Ocain | 91/304 |
| 1,502,244 | 7/1924 | Gore | 91/188 |
| 2,115,556 | 4/1938 | Maniscalco | 91/188 |
| 2,984,222 | 5/1961 | Smith | 91/188 |
| 3,220,316 | 11/1965 | Kummerman | 91/188 |
| 4,018,050 | 4/1977 | Murphy | 60/370 |

*Primary Examiner*—Paul E. Maslousky
*Attorney, Agent, or Firm*—Browdy and Neimark

[57] ABSTRACT

A compressed air-operated motor driven from a rechargeable compressed air supply tank. The motor has sets of symmetrically opposing cylinders having spring-biased air admission valves and containing drive pistons connected to a crankshaft. The supply tank is connected to the admission valves through respective pilot valves of a pair controlled by relay poppet valves alternately opened by a rotating cam driven by the crankshaft. The pilot valves control the delivery of compressed air alternately to two cylinder groups comprising alternately oppositely located cylinders, so that their pistons act to drive the crankshaft in a common direction by alternate power pulsations.

6 Claims, 9 Drawing Figures

COMPRESSED AIR-OPERATED MOTOR EMPLOYING AN AIR DISTRIBUTOR

FIELD OF THE INVENTION

This invention relates to compressed air-operated engine systems, and more particularly to a compressed air supply system including a distributing arrangement for an air engine of the type having groups of cylinders which are sequentially supplied with compressed air to deliver power impulses to a common crankshaft.

BACKGROUND OF THE INVENTION

In the course of development of pollution-reducing driving engines for motor vehicles, various systems have been proposed for operating vehicles by means of piston engines driven by compressed air. These systems usually involve the use of a source of compressed air, such as a readily rechargeable pressure tank, from which the working fluid is supplied to the engine cylinders through admission valves suitably timed to provide power strokes of the pistons, and on the return strokes the expanded air is allowed to discharge from the cylinders via suitably timed exhaust valves.

The admission of working fluid to the cylinders is usually controlled by a camshaft having individual cams acting on linkage systems operating respective air intake valves for the cylinders. In engines having groups of cylinders which are alternately acted on by the working fluid it is uneconomical to employ camshafts with individual cam elements and associated valve-operating linkage systems, and the engines of this type usually involve a large number of moving parts subject to frequent maladjustment and operational failure, are relatively cumbersome and noisy, and are inefficient in the utilization of compressed air. Also, in the case of compressed air engines of the dynamically balanced type it is desirable to employ a more reliable arrangement for synchronizing the timing of the power strokes of symmetrically arranged cylinder groups in order to maintain a proper dynamic balance.

Further background will be given by examining the following prior U.S. patents, which appear to represent the closest prior art relating to the present invention:

Jakowchuk, U.S. Pat. No. 3,190,182
Gardner et al., U.S. Pat. No. 3,618,468
Dickinson, U.S. Pat. No. 3,730,054
Murphy U.S. Pat. No. 4,018,050

SUMMARY OF THE INVENTION

Accordingly, an object of the invention is to overcome deficiencies in the prior art, such as mentioned above.

Another object is to provide for mobile powering in a manner causing reduced pollution.

Another object is to provide a novel and improved compressed air-operated system for the propulsion of a motor vehicle, or for other power needs, the system being non-polluting to the atmosphere, being quiet and smooth in operation, requiring relatively few moving parts as compared with previous systems proposed for similar functions, and having highly efficient valve means for admitting working fluid to its cylinders.

A further object of the invention is to provide an improved arrangement for controlling the supply of compressed air to the cylinders of a compressed air-operated engine, the control of the admission of the compressed air being more positive and reliable than in previously proposed air admission control systems, and the system of the present invention using a single cam instead of a camshaft with multiple air-admission cams.

A still further object of the invention is to provide an improved compressed air-operated multiple-cylinder engine, the engine having improved dynamic balance, being relatively compact in bulk, and utilizing a simple and efficient relay valve arrangement in cooperation with a distributing cam to effect the timely admission of compressed air to cylinders when the pistons of said cylinders are positioned for power strokes.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figures 1, 4:
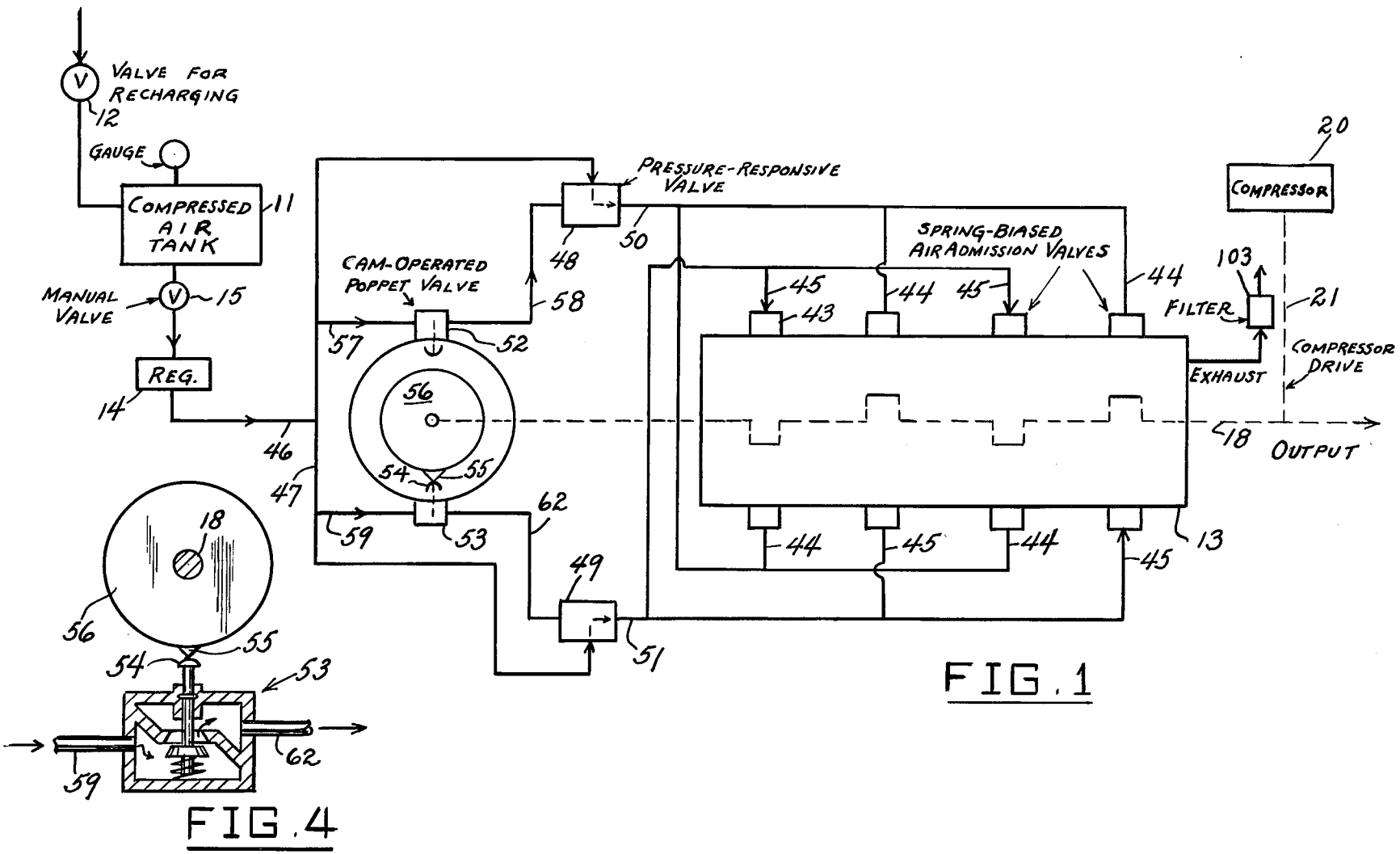
FIG. 1 is a schematic diagram of a typical improved compressed air-operated skid engine system in accordance with the present invention.
FIG. 4 is a cross-sectional view taken axially through one of the air-distributing poppet valves employed in the air-operated engine system of FIG. 1.

Referring to the drawings, FIG. 1 schematically illustrates the fluid circuit of a typical compressed air-driven motor system according to the present invention. The fluid circuit comprises a compressed air storage tank 11 which is chargeable with compressed air from a suitable external source through a control valve 12. Tank 11 is connected to a compressed air-driven engine 13 through a conventional pressure regulator 14 and a distributing system, presently to be described, whereby to furnish air at a suitable pressure to the power-generating cylinders of the engine. As will be presently described, the compressed air is supplied to said engine cylinders through a distributor which is timed to produce the power strokes of the engine pistons. At the ends of the power strokes the air is exhausted from the cylinders to an exhaust manifold 16 through timed exhaust valves 33, the opening of the exhaust valves being suitably timed by the action of a camshaft assembly 17 driven by the crankshaft 18 of the engine through a positive-drive transmission assembly designated generally at 19. The engine may be of a type employing conventional rocker arms 60 and push rods 61 to couple the camshaft assembly to the exhaust valves.

Tank 11 is provided with a manually operated outlet valve 15.

Crankshaft 18 is drivingly connected in a conventional manner through suitable clutch means and speed-changing means to the driving wheels of the associated vehicle.

The typical engine 13 comprises a block 23 formed with four symmetrically opposed pairs of cylinders 24, 25 arranged on opposite sides of the crankshaft 18 and having pistons 26, 27 rotatably connected to crank assemblages 28 of the crankshaft by connecting rods 29, 30.

Figure 5:
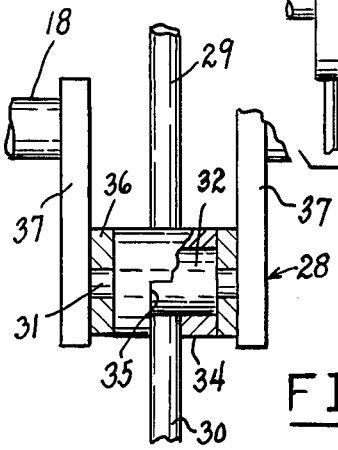
FIG. 5 is an enlarged elevational detail view, partly in cross-section, showing the connections of opposing piston rods to the crankshaft in the engine of FIG. 2.

The connecting rods 29, 30 are suitably connected to the crank pins 31 for mutual relative rotation, for example, in the manner illustrated in FIG. 5. Thus, rod 30 may have a connection sleeve portion 32 rotatably receiving crank pin 31 and being rotatably received in a sleeve portion 34 provided on the end of connecting rod 29 and being suitably notched at 35 to receive and allow relative rotation of connecting rod 30. Spacer rings 36 may be provided between the concentric sleeve 32, 34 and the crank arms 37, 37.

Figure 2:
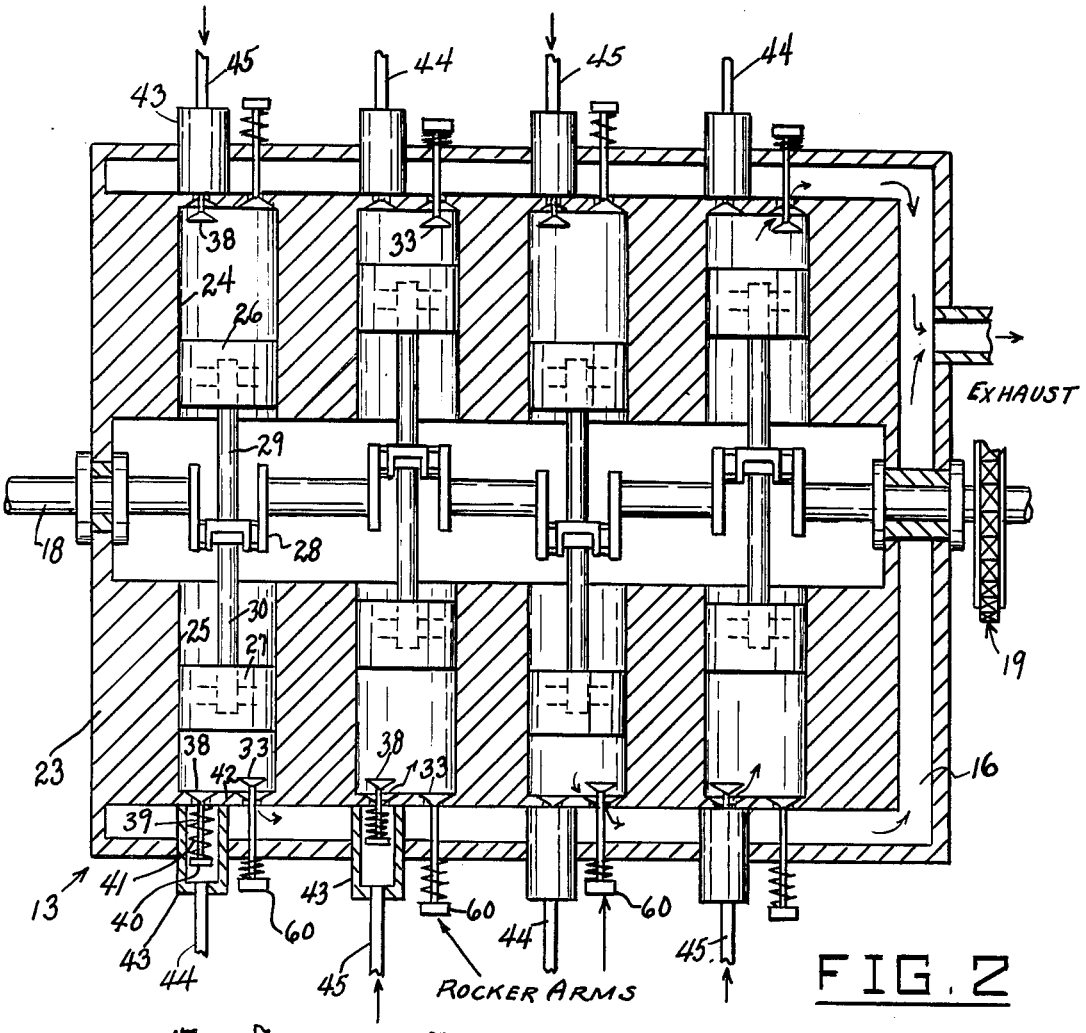
FIG. 2 is a horizontal cross-sectional view taken through a typical compressed air-operated engine such as that shown schematically in FIG. 1, employing rocker arm-actuated exhaust valves controlled by a camshaft.
Figure 3:
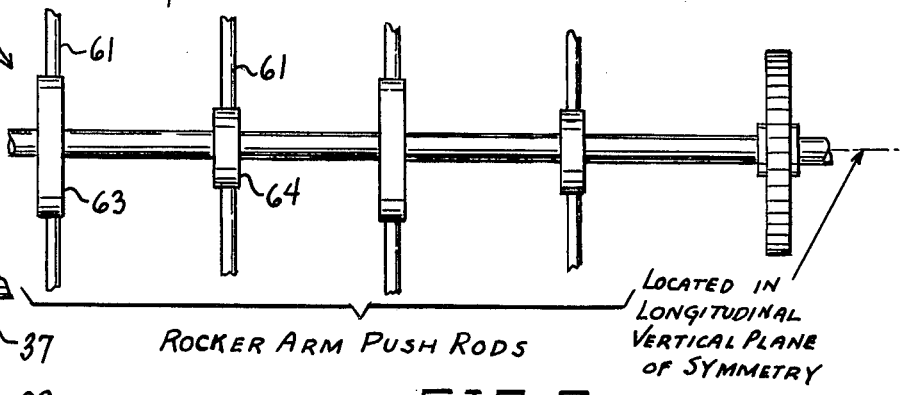
FIG. 3 is a fragmentary plan view of the camshaft and push rods used to actuate the exhaust valve rocker arms of FIG. 2.

As shown in FIG. 2, the exhaust valves 33 are provided in the end walls 42 of the respective cylinders. Also provided in valve seats formed in said end walls are air admission valve elements 38 comprising generally frusto-conical members having valve stems 39 with abutment heads 40. Coiled springs 41 surround the stems 39 and bear between heads 40 and the outer surfaces of the cylinder end walls 42 and bias the conical valve members 38 into said valve seats. Generally cylindrical valve housings 43 are rigidly secured to the block 23, surrounding the valve stems 39 and projecting outwardly. Respective compressed air supply conduits 44 and 45 are communicatively connected to the outer ends of the housings 43, as shown in FIG. 2. The conical valve members 38 open responsive to the admission of compressed air from tank 11 into the conduits 44 and 45.

From FIGS. 1 and 2, it will be seen that the conduits 44 and 45 are in alternating relation at each side of the engine 13, and are respectively connected to the valve housings 43 associated with opposing cylinders 24, 25.

An air supply line 46 from the regulator 14 is connected via a conduit 47 through respective normally closed conventional pressure-responsive pilot valves 48 and 49 to conduits 50 and 51. Conduit 50 is connected to the conduits 44 and conduit 51 is connected to the conduits 45. Pilot valve 48 is controlled by a first relay valve 52 and pilot valve 49 is controlled by a second relay valve 53.

Relay valves 52, 53 may be of the poppet type and are suitably mounted diametrically opposite each other with their plunger heads 54 in the path of movement of a projection 55 on the periphery of a cam disc 56 mounted on crankshaft 18. The control chamber of pilot valve 48 is connected to conduit 47 via a conduit 57, poppet valve 52 and a conduit 58. Similarly, the control chamber of pilot valve 49 is connected to conduit 47 via a cnduit 59, poppet valve 53 and a conduit 62.

In operation, when poppet valve 53 is opened by projection 55, as shown in FIG. 4, compressed air is applied to the control chamber of relay valve 49, admitting compressed air to conduits 45, and causing the compressed air to open and flow past the associated spring-biased valve elements 38 and into their associated engine cylinders. Thus, power strokes will be generated by the first and third pistons on the upper side of the engine, as viewed in FIG. 2, and the second and fourth pistons on the lower side. The generally oval cams 63, 64 of the exhaust camshaft assembly 17, positively driven by crankshaft 18, are arranged so that at this time the exhaust valves 33 for the second and fourth cylinders at the upper side of the engine and for the first and third cylinders at the lower side of the engine are opened, allowing free exhaust of spent air from said second and fourth upper and first and third lower cylinders to the exhaust manifold 16.

A corresponding action occurs 180° later when poppet valve 52 is opened, except that the power strokes are developed in the second and fourth upper and first and third lower cylinders, and the first and third upper and second and fourth lower cylinders are allowed to exhaust.

It will be noted that during exhaust the air admission valve elements 38 are held closed by their biasing springs 39 so as to minimize depressurization in the air admission chambers 43. Such depressurization would act to reduce the forces acting on the associated pistons in the subsequent power strokes and would therefore reduce overall engine efficiency.

The axis of camshaft assembly 17 is preferably located in the longitudinal vertical plane of symmetry of the engine 13 to maximize dynamic balance characteristics. Such characteristics are further enhanced by the substantially symmetrical locations of the respective rows of four cylinders 24 and 25 on opposite sides of the engine crankshaft, substantially in a common horizontal plane.

The engine system may be provided with an air compressor 20 driven from the crankshaft 18 by conventional coupling means 21, useful for driving air motor-driven equipment such as auxiliary generators.

A suitable anti-pollution filter unit 103 may be provided in the exhaust line to reduce pollution and noise.

The engine may be provided with a conventional electric starter driven by a battery. The associated vehicle may be further provided with a conventional battery charging system including a generator driven by the crankshaft 18. The compressor 20 may be driven by an electric motor energized from said generator instead of being driven directly from the crankshaft.

In starting the engine 13, valve 15 is opened and the starter motor is energized and operated in a conventional manner to rotate the crankshaft 18. This causes sequential opening of the poppet valves 52, 53 and allows compressed air to be delivered to the engine cylinders to develop power strokes in the manner above described, whereby to drive the engine.

Figure 6:
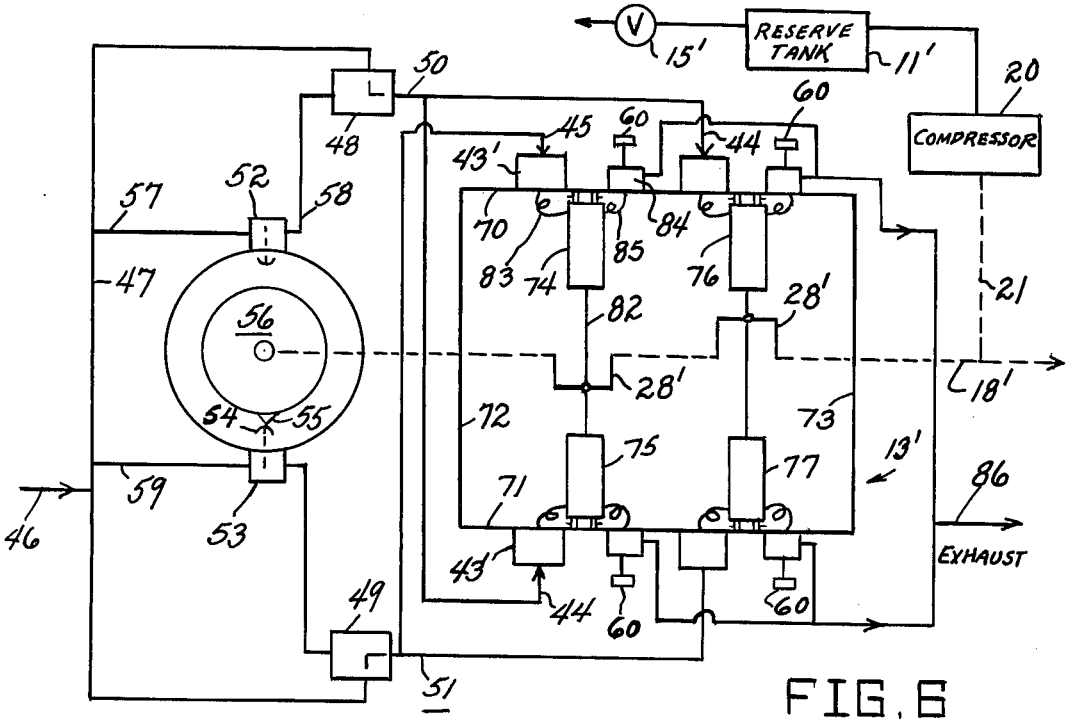
FIG. 6 is a schematic diagram of an alternative compressed air-operated engine system employing a compressed air storage tank.
Figure 7:
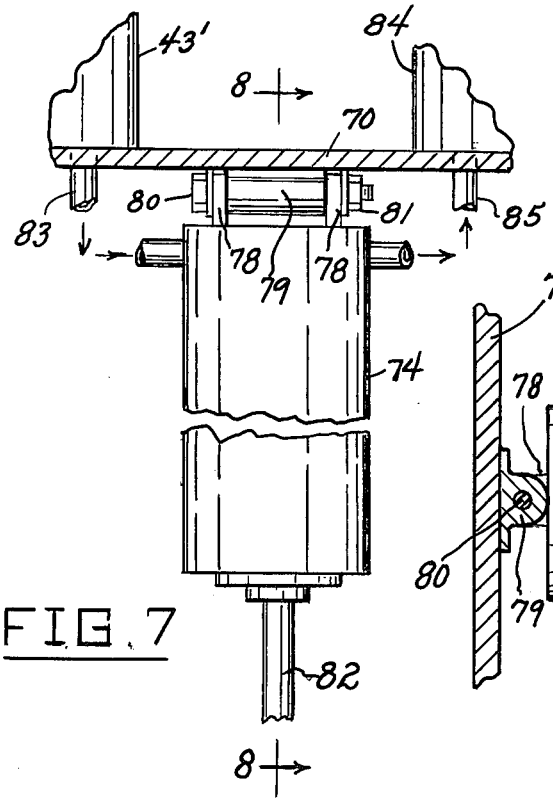
FIG. 7 is a fragmentary horizontal cross-sectional view taken through a portion of the engine of FIG. 6, showing one of the pivoted cylinders employed in the engine.
Figure 8:
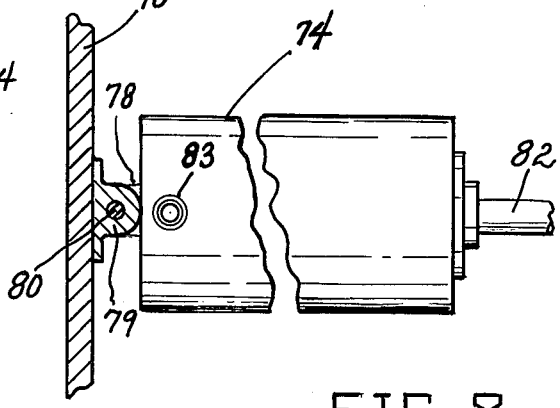
FIG. 8 is a fragmentary vertical cross-sectional view taken substantially on the line 8—8 of the FIG. 7.

FIGS. 6, 7 and 8 show an alternative embodiment wherein the engine is designated generally at 13' and comprises a housing having opposite longitudinal vertical walls 70, 71 and transverse vertical end walls 72, 73. The crankshaft, shown at 18', is suitably journalled in the transverse end walls 72, 73. The engine has two sets of opposed cylinders 74, 75 and 76, 77. The cylinders 74, 76 arr hingedly pivoted to the longitudinal vertical wall 70 on an axis parallel to crankshaft 18', and the cylinders 75, 77 are likewise hingedly pivoted to the longitudinal vertical wall 71 on an axis parallel to said crankshaft. Thus, as shown in FIGS. 7 and 8, each cylinder is provided at its outer end with a pair of spaced parallel apertured hinge lugs 78, 78 which receive therebetween a hinge sleeve bracket 79 welded, or otherwise rigidly secured, to the adjacent vertical longitudinal wall 70 or 71. A hinge bolt 80 extends horizontally through the hinge lugs 78, 78 and the intervening sleeve bracket 79, forming a hinge connection of the cylinder to the adjacent longitudinal vertical housing wall. The bolt 80 is provided with a retaining nut 81.

The pivoted cylinders are provided with pistons having inwardly extending piston rods 82 which are rotatably connected in a conventional manner to the crank elements 28' of crankshaft 18'.

As shown diagrammatically in FIG. 6, the cylinders 74, 76 are arranged to correspond with the fixed first and second upper cylinders 24 of FIG. 2, and the cylinders 75, 77 are arranged to correspond with the fixed first and second lower cylinders 25 of FIG. 2, the cranks 28', 28' being in corresponding 180°-opposing relationship.

Pressure-responsive air admission valve assemblies 43', similar to those contained in the housings 43 of FIG. 2, are mounted on the vertical longitudinal walls 70, 71 adjacent the respective pivoted cylinders and are communicatively connected to the outer ends of the cylinders by flexible conduits 83. Suitably timed compressed air is furnished to the air admission valves 43' in the same manner as described above in connection with the previously described embodiment shown in FIGS. 1 to 5.

Respective rocker arm-operated exhaust valve assemblies 84 are similarly mounted on the vertical longitudinal housing walls 70, 71 adjacent the respective pivoted cylinders and are communicatively connected to the outer ends of the cylinders by flexible conduits 85. The exhaust valves 84 are operated by the rocker arms 60, which are, in turn, operated by a suitable camshaft assembly positively driven by crankshaft 18' in the same manner as in the previously-described embodiment. The outlets of the exhaust valves 84 are connected to an exhaust line 86.

The operation of the motor 13' is generally similar to that of the previously described embodiment of FIGS. 1 to 5, except that the pivoted cylinders 74–77 form part of active driving linkages between the cranks 28' and the fixed housing longitudinal vertical walls, whereas in the previously-described embodiment the cylinders are fixed and their piston rods are rotatably connected to their respective pistons.

In the various embodiments described herein, the exhaust air from the main engine may be employed to operate an intermediate compressed air engine which drives one or more generators to furnish electrical power to auxiliary electrical devices or appliances.

A compressor 20 may be driven from crankshaft 18' by conventional coupling means 21. The compressor 20 may be employed to charge a reserve tank 11' for at times operating auxiliary air motor-driven equipment. Tank 11' is provided with an outlet control valve 15'.

Figure 9:
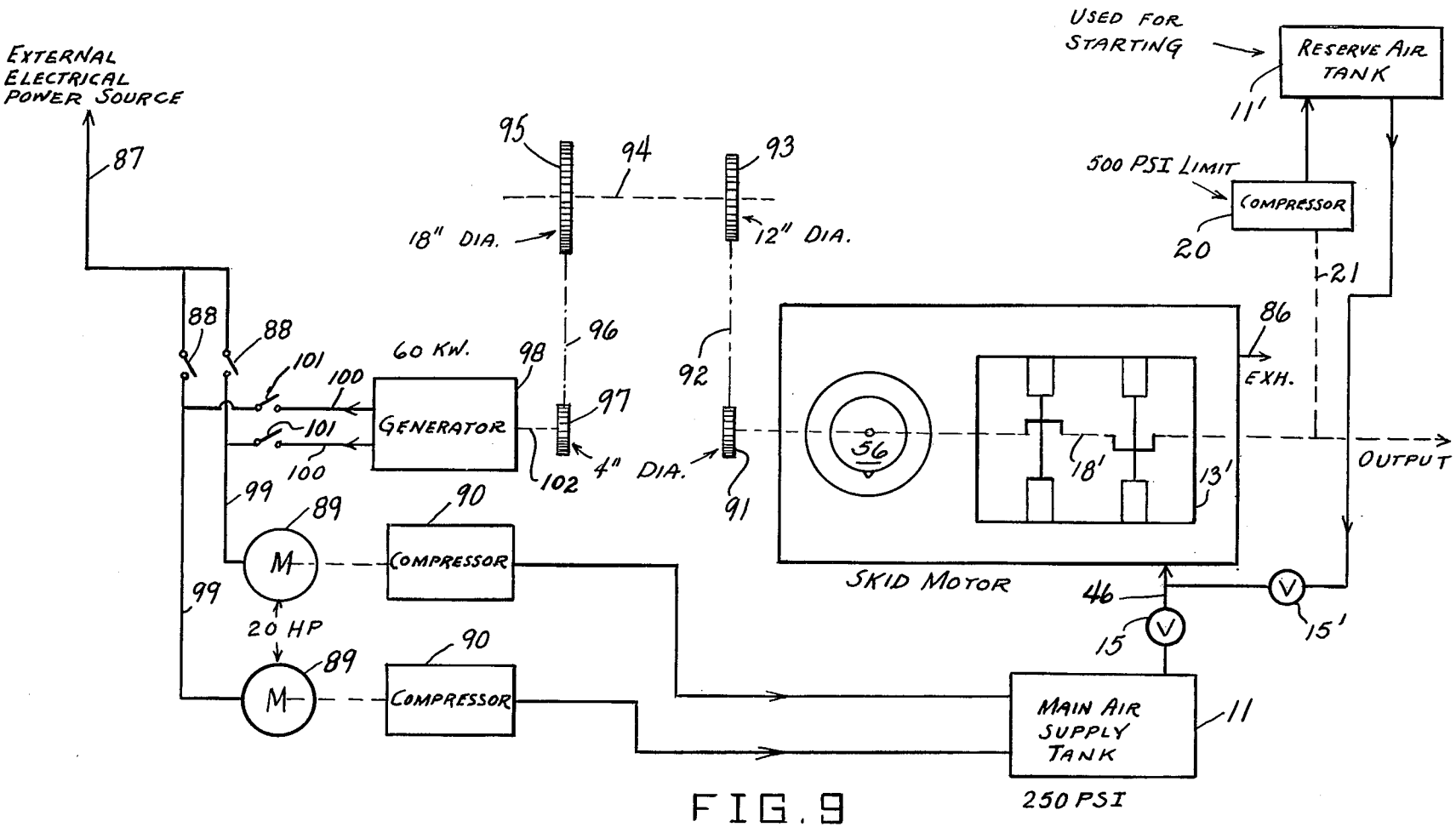
FIG. 9 is a schematic diagram of a stationary air-operated engine system which employs a compressed air storage tank and which may be driven from an external electrical power source.

FIG. 9 schematically illustrates a typical system similar to that shown in FIG. 6, energized from an external electrical power line 87. Line 87 is connected through control switches 88, 88 and lines 99, 99 to 20 HP electric motors 89, 89 which drive compressors 90, 90, which charge the main air supply tank 11 so as to provide 250 PSI therein at all times. Tank 11 supplies the main engine 13' with driving air through the control valve 15 and line 46.

A 4-inch gear pulley 91 on crankshaft 18' is drivingly coupled at 92 to a 12-inch gear pulley 93 mounted on a common shaft 94 with an 18-inch gear pulley 95, which is drivingly coupled at 96 with a 4-inch gear pulley 97 mounted on the shaft 103 of a 60 KW generator 98. The output of generator 98 is connected by lines 100, 100 and control switches 101, 101 to the respective motor supply lines 99, 99.

With switches 88, 88 and 101, 101 closed, the system will operated to charge tank 11 and to drive main air motor 13', in turn driving generator 98. When generator 98 delivers enough power to drive electric motor 89, 89, the switches 88, 88 may be opened so as to utilize the stored compressed air in main tank 11 for driving air motor 13'.

A compressor 20, driven from crankshaft 18' by conventional coupling means 21 will develop a limiting pressure of 500 PSI, which is supplied to and stored in a reserve tank 11'. This reserve tank is connected to air line 46 through a control valve 15', and is used to start the main air motor 13' from the reserve tank 11' at times, without requiring the use of an external power source, such as electrical supply line 87.

While certain specific embodiments of an improved compressed air-operated motor have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. In a compressed air engine system, a compressed air storage tank, an engine provided with opposed cylinders containing pistons and a crankshaft having crank elements connected to said pistons, and compressed air supply conduit means connecting said storage tank to said cylinders and including distributing valve means to alternately admit compressed air to the respective cylinders responsive to rotation of the crankshaft, said cylinders comprising two groups, each being arranged to act simultaneously as a group on the crankshaft, with the cylinders of one group opposing the cylinders of the other group, and wherein said distributing valve means comprises respective pressure-responsive pilot valves connected between the air storage tank and the groups of cylinders and controlling the admission of compressed air to the two groups, respective relay valves connected between the air storage tank and the pilot valves and controlling the opening of the pilot valves, and cam means on the crankshaft alternately operatively engageable with said relay valves responsive to the rotation of the crankshaft.

2. The engine system of claim 1, and wherein said relay valves comprise respective poppet valves mounted on the engine diametrically opposite each other and having operating elements located symmetrically relative to the crankshaft, and wherein said cam means comprises a cam on the crankshaft having a projection alternately engageable with said operating elements responsive to the rotation of the crankshaft.

3. The engine system of claim 2, and wherein the cylinders are provided with normally closed pressure-responsive air admission valves connected in fluid circuit with the associated pressure-responsive pilot valves.

4. The engine system of claim 3, and wherein said cylinders are arranged substantially in a common horizontal plane on opposite sides of and substantially symmetrically with respect to said crankshaft.

5. The engine system of claim 4, and wherein the engine is provided with exhaust valves in the respective cylinders and with exhaust manifold means communicating with said cylinders through said exhaust valves, camshaft means driven by said crankshaft, and means coupling said camshaft means to said exhaust valves and arranged to open the exhaust valves of one group of cylinders when compressed air is admitted into the cylinders of the other group.

6. The engine system of claim 5, and wherein said camshaft means is located substantially in a longitudinal vertical plane of symmetry of the engine.

* * * * *